US008007100B2

(12) United States Patent
Ishihara et al.

(10) Patent No.: US 8,007,100 B2
(45) Date of Patent: Aug. 30, 2011

(54) RECORDING APPARATUS

(75) Inventors: Masaaki Ishihara, Kawasaki (JP); Koichiro Kawaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 546 days.

(21) Appl. No.: 12/042,211

(22) Filed: Mar. 4, 2008

(65) Prior Publication Data

US 2008/0218578 A1 Sep. 11, 2008

(30) Foreign Application Priority Data

Mar. 5, 2007 (JP) ..... 2007-053752

(51) Int. Cl.
*B41J 2/01* (2006.01)

(52) U.S. Cl. ..... 347/104; 347/101; 400/636

(58) Field of Classification Search ..... 347/101, 347/104; 400/636
See application file for complete search history.

(56) References Cited

U.S. PATENT DOCUMENTS

| | | | | |
|---|---|---|---|---|
| 6,042,112 | A * | 3/2000 | Izumi | 271/273 |
| 6,189,990 | B1 * | 2/2001 | Youn | 347/8 |
| 6,293,670 | B1 * | 9/2001 | Taniguro et al. | 347/104 |
| 6,550,907 | B2 * | 4/2003 | Uchida | 347/104 |
| 6,979,080 | B2 * | 12/2005 | Samoto et al. | 347/104 |
| 7,527,371 | B2 * | 5/2009 | Yanagi et al. | 347/104 |
| 7,530,449 | B2 * | 5/2009 | Nakashima et al. | 198/810.03 |
| 2003/0011671 | A1 * | 1/2003 | Sinmmachi | 347/104 |

* cited by examiner

*Primary Examiner* — Daniel Petkovsek
(74) *Attorney, Agent, or Firm* — Canon U.S.A., Inc., IP Division

(57) ABSTRACT

There is provided a recording apparatus in which a pressure contact position of a pinch roller to a conveying roller and a distance between the pressure contact position of the pinch roller and a platen can be properly set corresponding to different recording conditions so that a high quality image can be recorded even under the different recording conditions. A movement of the pressure contact position in which the pressure contact position of the pinch roller 37 to the conveying roller is moved by moving a pinch roller holder and a movement of the platen in which a position of the platen which faces a recording head 7 is moved for the pressure contact position of the pinch roller are executed in an interlocking relational manner.

10 Claims, 11 Drawing Sheets

RECORDING APPARATUS

BACKGROUND OF THE INVENTION

1. Field of the Invention

The present invention relates to a recording apparatus for recording an image onto a recording sheet by a recording head.

2. Description of the Related Art

A recording apparatus is constructed so as to record an image onto a recording sheet such as paper, plastic sheet, or the like based on image information. The recording apparatuses can be classified into an ink jet system, a wire dot system, a thermal system, a laser beam system, and the like according to a recording system. In a recording apparatus of a serial type using a recording head which moves in the width direction of the recording sheet, the recording is executed to the whole recording sheet while alternately repeating the recording of an amount corresponding to one line and the conveyance of a predetermined pitch. In a recording apparatus of a line type which records only by a scan in the conveying direction of the recording sheet, the recording of the whole recording sheet is executed by executing the conveyance of the predetermined pitch while continuously executing the recording of one line in a lump.

FIG. 14 is a partial vertical sectional view of a recording apparatus of the related art. In FIG. 14, a recording head 1301 executes the recording by discharging ink onto a recording sheet S1. A platen 1302 supports the recording sheet S1 at a position where it faces the recording head 1301. A conveying roller 1303 conveys the recording sheet S1 on the upstream side of the recording head 1301 in the conveying direction of the recording sheet. A pinch roller 1304 generates a conveying force by coming into pressure contact with the conveying roller 1303. A sheet discharge roller 1305 ejects the recorded recording sheet S1 to the outside of an apparatus main body. A driven roller 1306 such as a spur or the like generates a conveying force by coming into pressure contact with the sheet discharge roller 1305. The recording apparatus is constructed in such a manner that a pressure contact point of the pinch roller 1304 to the conveying roller 1303 is deviated at the downstream side in the conveying direction of the recording sheet, thereby pressing the recording sheet S1 onto the platen 1302. A nip portion 1308 is formed between the sheet discharge roller 1305 and the driven roller 1306.

However, in the case of pressing the recording sheet onto the platen by deviating the pressure contact point of the pinch roller, an optimum position of the pinch roller differs depending on conditions such as recording sheet type, conveying conditions, environmental conditions, ink type, image forming area, and the like. Among those various kinds of conditions, there are also conditions which are reciprocal to one of a movement amount and the moving direction. Therefore, a certain margin is allowed for recording quality by using a method whereby the apparatus is designed based on an intermediate value of an optimum value, a method whereby design values are determined by weighting each recording condition, or the like.

SUMMARY OF THE INVENTION

The present invention is directed to a recording apparatus in which a pressure contact position of a pinch roller to a conveying roller and a distance between the pressure contact position of the pinch roller and a platen can be properly set corresponding to recording conditions so that high quality recording can be performed.

According to one aspect of the present invention, a recording apparatus for recording onto a recording sheet by a recording head, includes: a platen configured to guide the recording sheet to a position where it faces the recording head; a conveying roller which conveys the recording sheet on an upstream side of the platen in a conveying direction of the recording sheet; a pinch roller which generates a conveying force of the recording sheet by coming into pressure contact with the conveying roller; and a pinch roller holder which rotatably holds the pinch roller. By moving the pinch roller, a pressure contact position of the pinch roller to the conveying roller is moved and a position of the platen to the pressure contact position is changed.

Further features of the present invention will become apparent from the following description of exemplary embodiments with reference to the attached drawings.

BRIEF DESCRIPTION OF THE DRAWINGS

FIGS. 13A, 13B and 13C are diagrams each illustrating a state of a curl of the recording sheet obtained after the recording, in which FIG. 13A illustrates the curl in such a direction that the recording surface becomes concave, FIG. 13B illustrates the state without the curl, and FIG. 13C illustrates the curl in such a direction that the recording surface obtained after the recording becomes convex.

DESCRIPTION OF THE EMBODIMENTS

Figure 1:
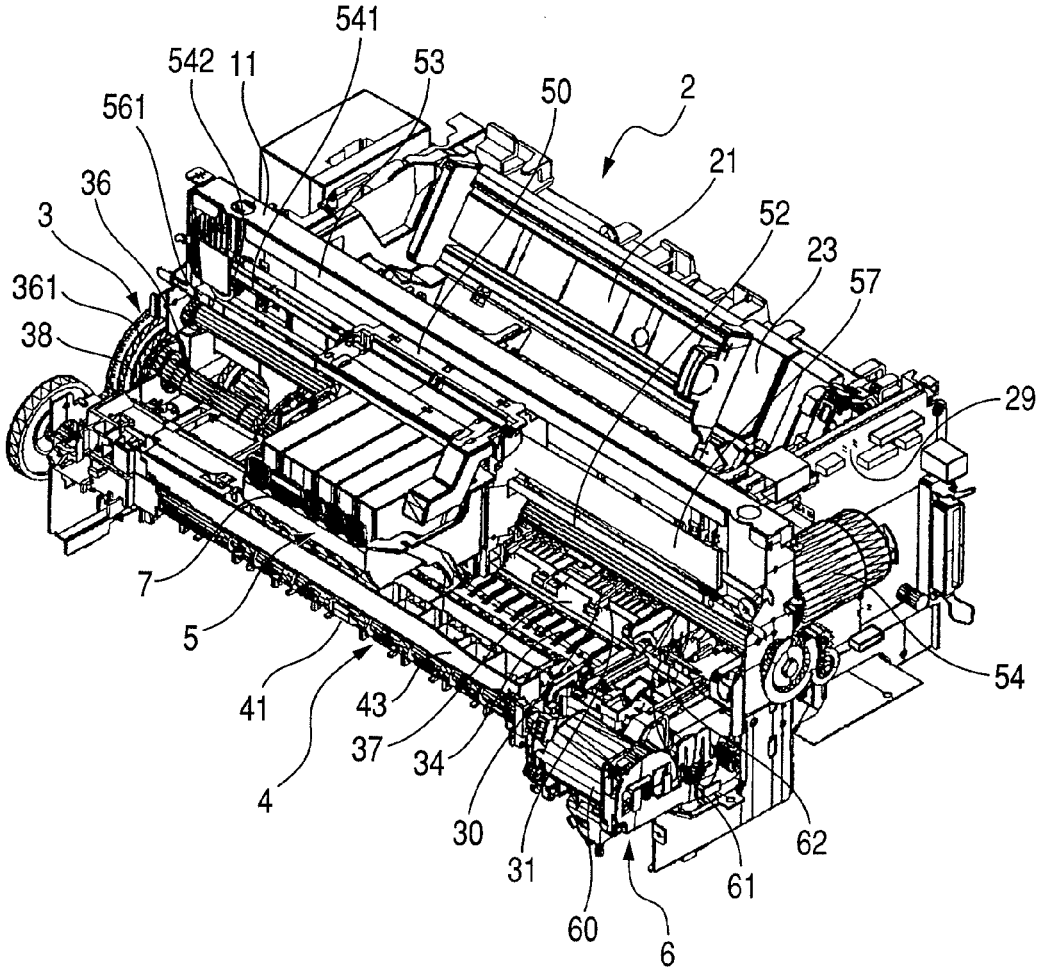
FIG. 1 is a perspective view of a recording apparatus according to an embodiment of the invention when seen from the right front side.
Figure 2:
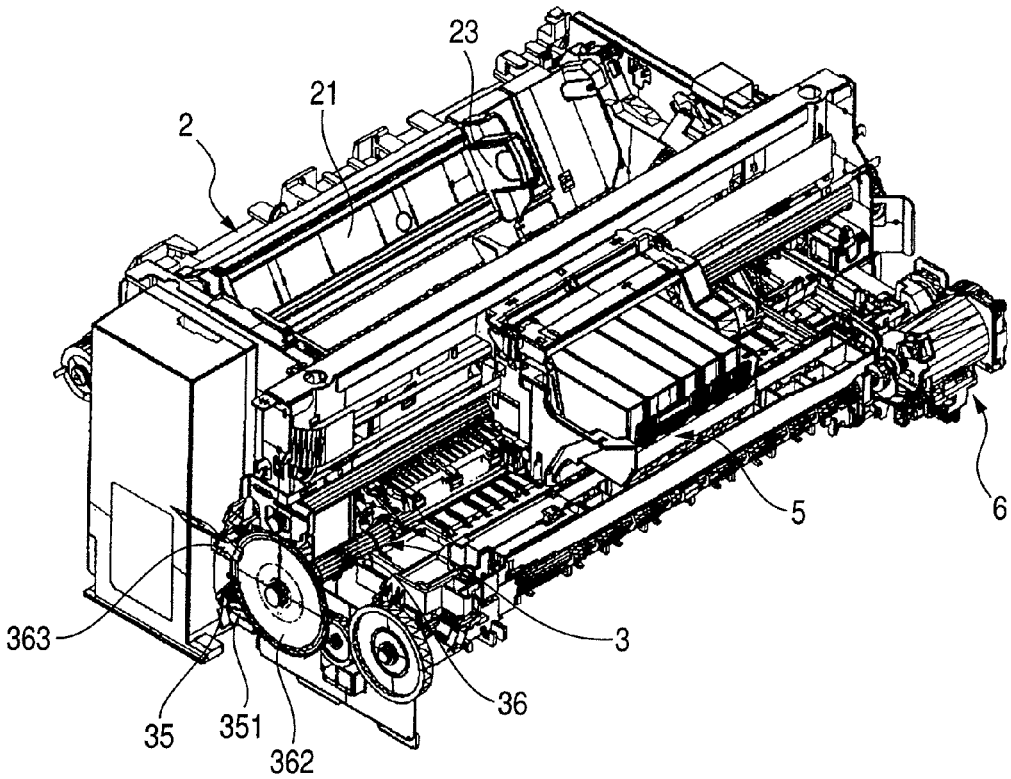
FIG. 2 is a perspective view of the recording apparatus of FIG. 1 when seen from the left front side.
Figure 3:
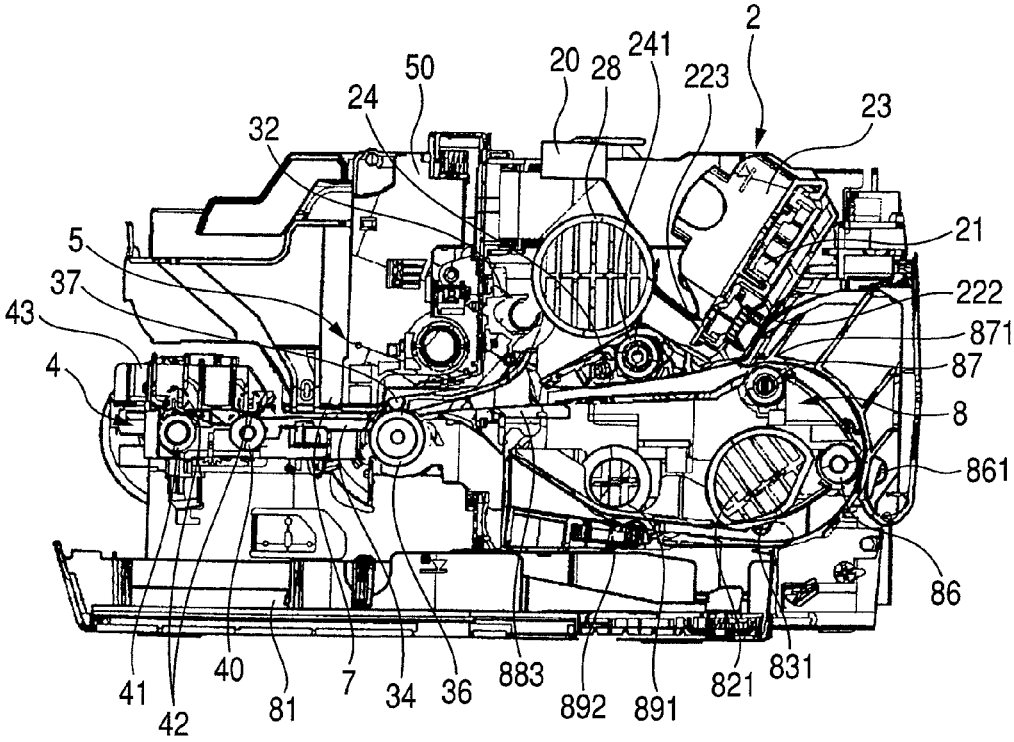
FIG. 3 is a vertical sectional view of the recording apparatus of FIG. 1.

An embodiment of the invention will be described hereinbelow with reference to the drawings. The same or corresponding portions are designated by the same reference numerals through all diagrams. FIG. 1 is a perspective view of a recording apparatus according to an embodiment of the invention when seen from the right front side. FIG. 2 is a perspective view of the recording apparatus of FIG. 1 when seen from the left front side. FIG. 3 is a vertical sectional view of the recording apparatus of FIG. 1. FIGS. 1 to 3 illustrate a case where the recording apparatus is an ink jet recording apparatus. In FIGS. 1 to 3, the recording apparatus has a feeding unit 2, a conveying unit 3, a sheet discharging unit 4, a carriage unit 5, a recovery processing unit 6, and a U-turn conveying unit 8. The carriage unit 5 records an image while scanning a recording sheet by a carriage 50 to which a recording head 7 has been mounted. An openable and closable feeding tray and a discharge tray are provided in a sheathing housing portion (not shown).

The feeding unit 2 is constructed by attaching a pressing plate 21 on which the recording sheets are stacked, a feed roller 28 for feeding the recording sheet, a separating roller 241 for separating the recording sheets, and the like onto a base 20. The feeding tray for holding the recording sheets stacked on the pressing plate 21 has been attached to the sheathing portion in a rear portion of the apparatus. A movable side guide 23 for restricting a stacking position of the recording sheets has slidably been attached to the pressing plate 21. The pressing plate 21 can pivot around a center shaft provided for the base 20 and has been urged to the feed roller 28 by a pressing plate spring 222. A separating sheet 223 for preventing an overlap-feed of the recording sheets is provided in a portion of the pressing plate 21 which faces the feed roller 28. The separating sheet is made of a material having a large coefficient of friction. The pressing plate 21 comes into contact with and separates from the feed roller 28 by a pressing plate cam (not shown) at predetermined timing.

The separating roller 241 for separating the recording sheets one by one is rotatably and axially supported to a separating roller holder 24 attached to the base 20. The separating roller 241 is urged onto the feed roller 28 by spring-urging the separating roller holder 24. The separating roller 241 is axially supported through a torque limiter and rotates when a load torque of a predetermined value or more acts on the separating roller. The separating roller 241 can come into contact with and separate from the feed roller 28. Positions of the pressing plate 21, the separating roller 241, and the like are detected by an ASF sensor 29.

A conveying roller 36 for conveying the recording sheet and a PE (paper edge) sensor 32 are provided for the conveying unit 3. The conveying roller 36 is a roller obtained by coating the surface of a metal axis with microparticles of ceramics. The conveying roller 36 is axially supported in the metal axis portions at both ends by a bearing 38 provided for a chassis 11. A plurality of pinch rollers 37 come into pressure contact with the peripheral surface of the conveying roller 36. Each of the pinch rollers 37 is held in a pinch roller holder 30 and produces a conveying force when it is come into pressure contact with the conveying roller 36 by a pinch roller spring 31. A pulley 361 is attached to an axis of the conveying roller 36. The conveying roller 36 is driven by transferring a rotation of a conveying motor 35 to the pulley 361 through a timing belt 351. A code wheel 362 for detecting a conveyance amount is attached to the axis of the conveying roller 36. The conveyance amount is detected by reading a marking of the code wheel by an encoder sensor 363.

Subsequently, the carriage unit 5 will be described. An image forming unit by the recording head 7 is formed on a downstream side of the conveying roller 36 in the conveying direction of the recording sheet. In the image forming unit, an image is formed by the recording head 7 onto the recording sheet supported by a platen 34. The recording head 7 has been mounted in the carriage 50 which can be reciprocatively moved. The recording head 7 has an ink discharge portion having a plurality of discharge ports for discharging ink droplets based on image information. As an ink discharge portion, for example, an ink discharge portion of an electrothermal converting system in which the ink in the discharge port is heated by a heater and film-boiled by a thermal energy is used. The ink droplet is discharged from the discharge port of the recording head 7 by a pressure change that is caused by a growth or contraction of a bubble which is caused by the film boiling. The image is recorded onto the recording sheet by selectively discharging the ink droplet from each discharge port.

The carriage 50 is guided and supported so that it can be reciprocatively moved to the right and left along a guide shaft 52 and a guide rail 53. The guide shaft 52 is attached to the chassis 11. The guide rail 53 is formed integratedly with the chassis 11. The carriage 50 is driven by a carriage motor 54 through a timing belt 541 suspended between the carriage motor 54 and an idle pulley 542. A code strip 561 is provided in parallel with the guide shaft 52. A position and speed of the carriage 50 can be detected by reading a marking of the code strip 561 by an encoder sensor provided for the carriage 50. A flexible circuit board 57 to transmit a head signal to the recording head 7 has been connected to the carriage 50. By the movement of the carriage 50, the main scan of the recording head 7 is executed to the recording sheet which is conveyed by the conveying roller 36 and the pinch rollers 37, so that the recording of one line is executed. By alternately repeating the recording of one line and the feeding of the recording sheet, the recording of the whole recording sheet is executed.

Subsequently, the sheet discharging unit 4 will be described. Two sheet discharging rollers 40 and 41 are arranged in the sheet discharging unit 4. The first sheet discharging roller 40 is driven by the rotation of the conveying roller 36 through a gear train and the like. The second sheet discharging roller 41 is driven by the rotation of the first sheet discharging roller 40. A spur 42 comes into pressure contact with each sheet discharging roller. The first sheet discharging roller 40 and the second sheet discharging roller 41 are attached to the platen 34. The spur 42 has a structure in which a thin plate such as SUS or the like having a plurality of convex shapes on its peripheral surface has been molded integratedly with a resin portion. The spur is rotatably supported to a spur holder 43 by an axis made by a coil spring. The spurs 42 are pressed onto the sheet discharging rollers 40 and 41 by urging forces of the coil springs. The recorded recording sheet is sandwiched between the sheet discharging rollers 40 and 41 and the spurs 42, conveyed, and ejected to the outside from the apparatus main body.

In the ink jet recording apparatus, the recovery processing unit 6 for preventing a clogging of the discharge port of the recording head 7 and maintaining and recovering ink discharging performance is provided. The recovery processing unit 6 has a suction pump 60, a cap 61, and a wiper 62. The cap 61 covers the discharge port of the recording head 7, thereby preventing the ink from drying and the dust or the like from depositing. The suction pump 60 is connected to the cap 61 and sucks the ink from the discharge port in a state where the discharge port has been sealed by the cap 61. The wiper 62 wipes up and cleans the discharge surface of the recording head. As a suction pump 60, a tube pump which squeezes a tube connected to the cap 61, a negative pressure occurring in the tube is made to act on the discharge port is used.

The U-turn conveying unit 8 will now be described. A U-turn conveying path for enabling a two-sided printing is provided for the U-turn conveying unit 8. A feeding cassette 81 containing the recording sheets therein is attached to a position near the front, in a lower portion of the apparatus main body. A pressing plate for pressing the stacked recording sheets to a feeding roller 821 is provided in the feeding cassette 81. A top one of the stacked recording sheets is separated by a cooperation of the feeding roller 821, a separating roller 831 and a separating sheet, and is conveyed to the U-turn conveying path. The separated recording sheet is conveyed toward the image forming unit by a first intermediate roller 86 and a second intermediate roller 87 provided at two positions of the U-turn conveying path and pinch rollers 861 and 871 which are in pressure contact with those intermediate rollers. A change-over flapper 883 is arranged at a meeting point of a conveying path of the feeding unit 2 and a conveying path of the U-turn conveying unit 8. The recording sheet conveyed from the U-turn conveying path is fed to a nip portion between the conveying roller 36 and the pinch rollers 37. While the recording sheet is conveyed onto the platen 34 by the conveying roller 36, an image is formed by the recording head 7.

Subsequently, a case of performing the two-sided recording by using the U-turn conveying unit 8 will be described. First, the recording sheet fed from the feeding unit 2, the recording sheet fed from the feeding cassette 81, and the recording sheet fed from a horizontal feeding unit 10, which will be described hereinafter, are conveyed on the platen 34 by the conveying roller 36, and the image is recorded onto the first surface by the recording head 7. In the case of recording the image onto only the first surface, the recording sheet is ejected as it is to the outside of the apparatus main body by the sheet discharging rollers 40 and 41. In the case of performing the two-sided recording, after completion of the recording of the first surface, the change-over flapper 883 is switched to the U-turn conveying path side and, at the same time, the conveying roller 36 is reversely driven.

Thus, the recording sheet whose first surface has been recorded is sent to the U-turn conveying unit 8. The recording sheet sent to the U-turn conveying unit is fed to a nip portion between a two-side roller 891 and a pinch roller 892. The two-side roller 891 is arranged on the upstream side of the feeding roller 821 in the conveying direction of the recording sheet. By the both-side roller 891 and the pinch roller 892, the recording sheet is conveyed to the U-turn conveying path on which the first intermediate roller 86 and the second intermediate roller 87 have been arranged. The reversed recording sheet is conveyed again to the conveying roller 36. At this time, the change-over flapper 883 is returned to the position where the image is recorded onto the first surface. While the recording sheet is conveyed by the forward driving of the conveying roller 36, an image is recorded onto the second surface by the recording head 7. The recording sheet obtained after completion of the recording of the second surface is ejected to the outside of the apparatus main body by the sheet discharging rollers 40 and 41.

Figure 4:
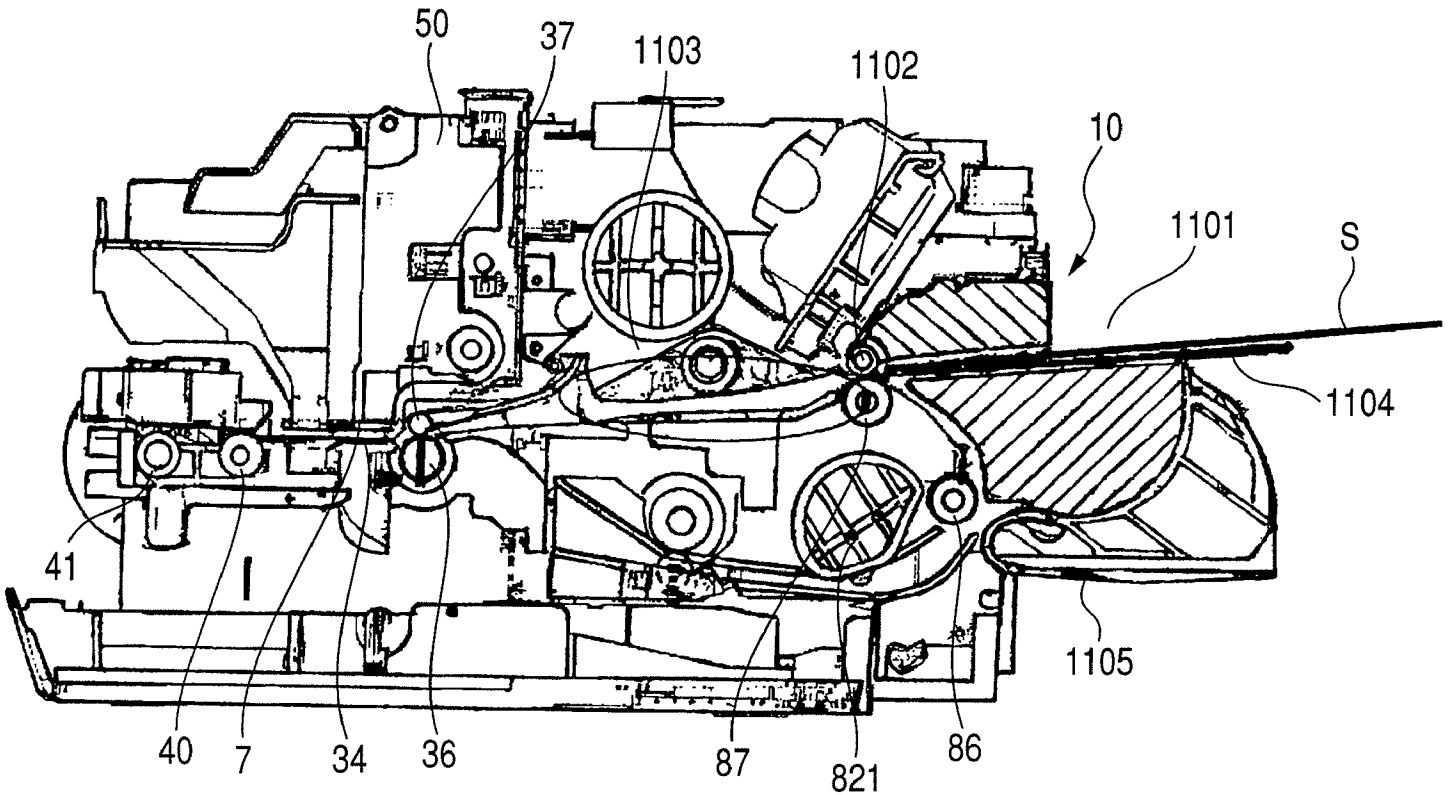
FIG. 4 is a vertical sectional view illustrating a state where a horizontal feeding unit has been attached to the recording apparatus of FIG. 1.
Figure 5:
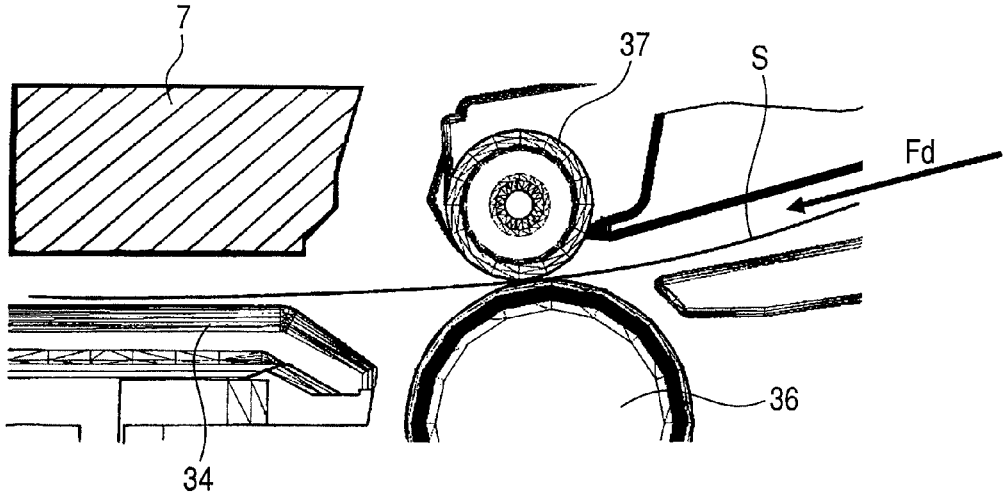
FIG. 5 is a partial vertical sectional view illustrating states of a pinch roller and a platen at the time when a pressing force of a recording sheet onto the platen is set to a small value in the embodiment of the invention.
Figure 6:
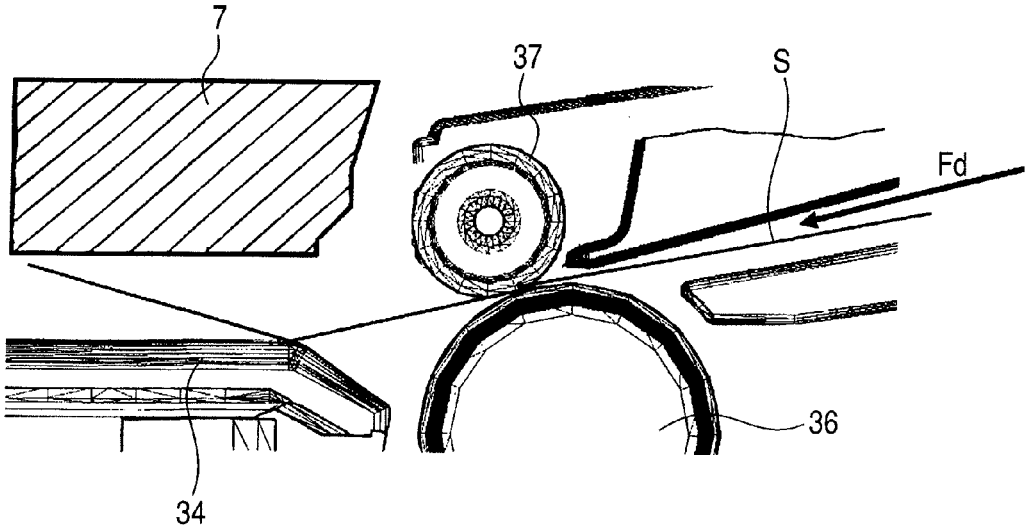
FIG. 6 is a partial sectional view illustrating a state where a pressure contact position of the pinch roller has been moved from the state of FIG. 5, the pressing force of the recording sheet has been increased, the platen has been descended, and a distance to the platen has been increased.
Figure 7:
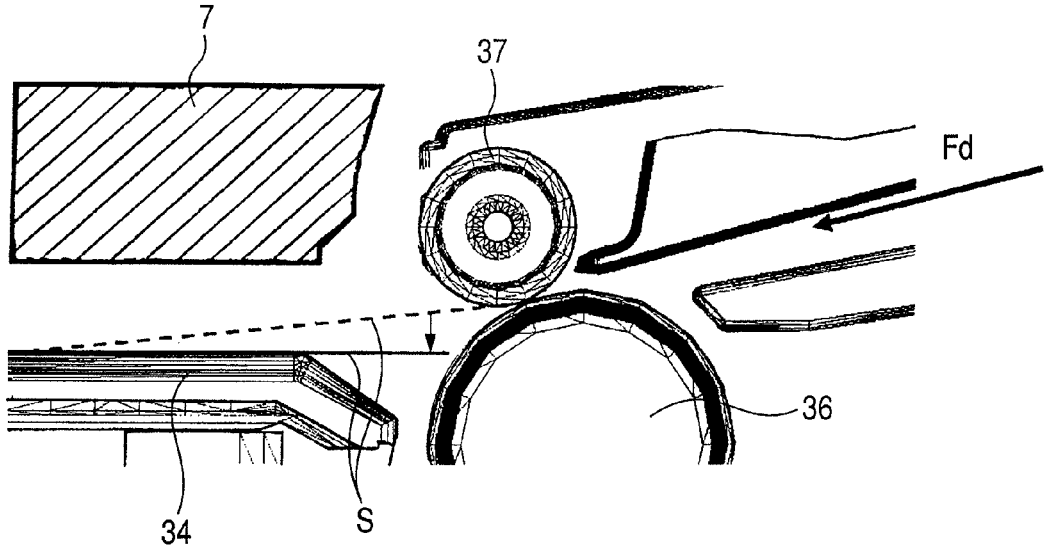
FIG. 7 is a partial vertical sectional view illustrating a state where a rear edge of the recording sheet conveyed in the state of FIG. 6 has come out of a nip between a conveying roller and the pinch roller.
Figure 8:
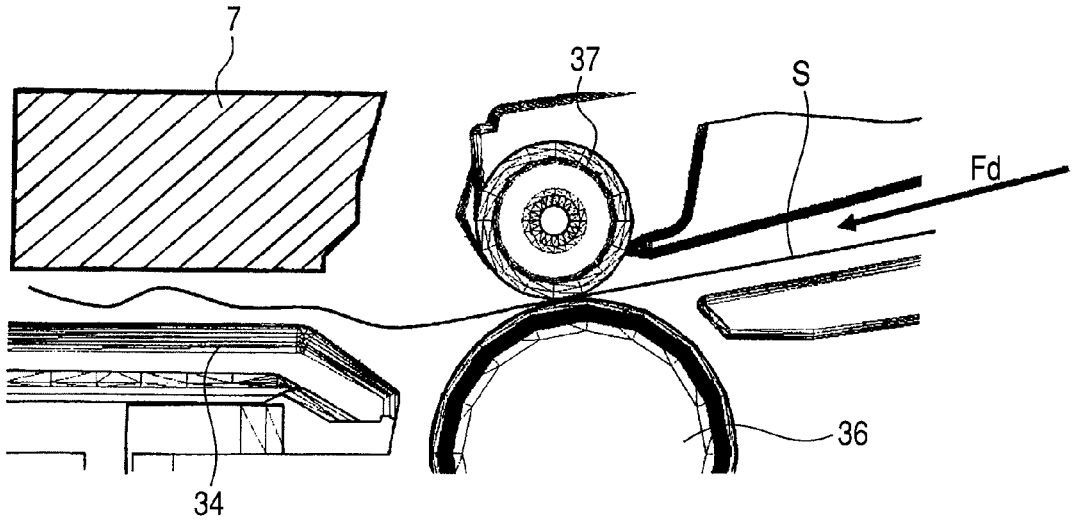
FIG. 8 is a partial vertical sectional view illustrating an unstable action of the recording sheet at the time when the recording sheet of low rigidity is conveyed in the state of FIG. 5.
Figure 9:
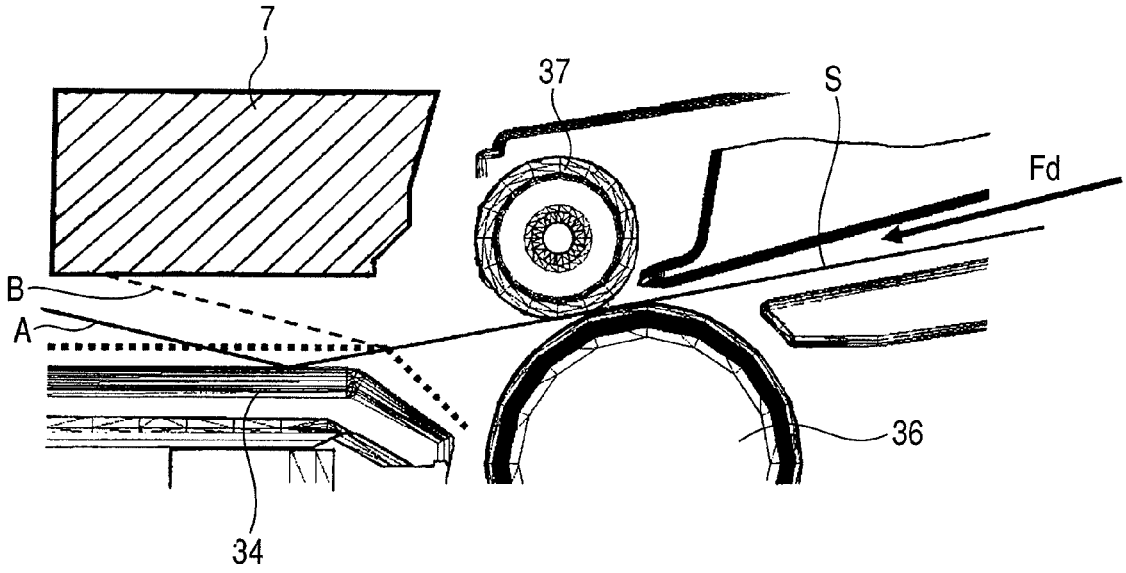
FIG. 9 is a partial sectional view illustrating a state where the pressure contact position of the pinch roller has been moved from the state of FIG. 8, the pressing force of the recording sheet has been increased, the platen has been descended, and the distance to the platen has been increased.

FIG. 4 is a vertical sectional view illustrating a state where the horizontal feeding unit has been attached to the recording apparatus of FIG. 1. The horizontal feeding unit 10 has: a horizontal unit 1101 for feeding the recording sheet; and the second intermediate roller 87 arranged in the U-turn conveying unit 8. Further, the horizontal feeding unit 10 has: a horizontal pinch roller 1102 attached to the horizontal unit 1101; and a feeding path 1103 which is used upon two-sided recording. The horizontal unit 1101 is a detachable type. By opening a cover 1105 of the U-turn conveying unit 8, the horizontal unit 1101 is attached to the apparatus main body. The horizontal feeding unit 10 is suitable for the case of recording the image onto the recording sheet which has high rigidity and which is difficult to be curved. The horizontal feeding unit 10 is arranged almost in parallel with the platen 34. Since there are no separating rollers in the horizontal feeding unit 10, recording sheets S are manually set onto a horizontal tray 1104 one by one by the user. The second intermediate roller 87 plays a role of the feeding roller in the horizontal feeding unit 10. A front edge portion of the set recording sheet S engages with a nip between the second intermediate roller 87 and the horizontal pinch roller 1102. The recording sheet which has been set in this manner is conveyed in a manner similar to the case of the U-turn conveyance and is fed to the nip between the conveying roller 36 and the pinch roller 37.

subsequently, optimum conditions of a pressure contact position of the pinch roller 37 to the conveying roller 36 and a distance between the pressure contact position and the platen 34 for various conditions at the time of recording in the above construction will be described. FIG. 5 is a partial vertical sectional view illustrating a state of the pinch roller and the platen at the time when a pressing force of the recording sheet onto the platen is set to a small value in the recording apparatus according to the embodiment of the invention. FIG. 6 is a partial sectional view illustrating a state where the pressure contact position of the pinch roller has been moved from the state of FIG. 5, the pressing force of the recording sheet has been increased, the platen has been descended, and a distance to the platen has been increased. FIG. 7 is a partial vertical sectional view illustrating a state where a rear edge of the recording sheet conveyed in the state of FIG. 6 has come out of the nip between the conveying roller and the pinch roller. FIG. 8 is a partial vertical sectional view illustrating an unstable action of the recording sheet at the time when the recording sheet of low rigidity is conveyed in the state of FIG. 5. FIG. 9 is a partial sectional view illustrating a state where the pressure contact position of the pinch roller has been moved from the state of FIG. 8, the pressing force of the recording sheet has been increased, the platen has been descended, and the distance to the platen has been increased. An arrow Fd in FIGS. 5 to 9 indicates a conveying direction of the recording sheet.

In FIGS. 5 to 9, the pressure contact position of the pinch roller 37 to the conveying roller 36 is set to such a position so as to press the recording sheet onto the platen 34. This is because of the following three points. First, when recording onto the recording sheet S, it is intended to improve image recording quality by stably setting a distance between the recording head and the recording sheet to a desired distance. Second, in the image forming unit, the recording sheet is stabilized in a state where the recording sheet is slightly floated by a repulsion from the platen 34, thereby preventing the recording sheet S during the recording from entering a groove formed on the upper surface of the platen 34. Third, when the recording sheet is made to enter a nip portion between the sheet discharging roller 40 and the spur 42, the recording sheet stably engages with the nip portion in order to prevent such a situation that the recording sheet collides with one of the sheet discharging roller or the gear and is damaged or a defective conveyance of the recording sheet occurs.

However, a tear-resistance, a warping direction, a warping degree, or the like of the recording sheet changes depending on a recording sheet type, a form of a conveying path to the conveying roller, a recording situation of the first surface at the time of recording the second surface, an ambient environment of the recording apparatus, or the like. Therefore, optimum values of the pressing force of the recording sheet onto the platen differ depending on various recording conditions, respectively.

For example, in the case of recording onto a recording sheet having high rigidity such as high quality paper for photograph printing or the like, as illustrated in FIG. 5, by reducing the pressing force of the recording sheet onto the platen, the recording sheet conforms with the platen and the distance between the recording head 7 and the recording sheet is stabilized. Thus, the high quality image recording can be performed. As illustrated in FIG. 6, if the pressure contact position of the pinch roller 37 is moved forward and the recording sheet is strongly pressed onto the platen, the front edge of the recording sheet is rebound by the repulsion which is received from the platen 34. Therefore, not only the distance from the recording sheet to the recording head 7 is not stabilized but also the recording sheet is rebound in such a direction as to approach the recording head and contacts with the recording head, or the like, so that a fouling or the like of the recording sheet occurs. Therefore, in the case of recording onto the recording sheet having the high rigidity, it is necessary to increase the distance from the pressure contact position (nip position) of the pinch roller 37 to the conveying surface of the platen 34.

However, if the distance from the pressure contact position of the pinch roller 37 to the conveying surface of the platen 34 is increased, as illustrated in FIG. 7, when the rear edge of the recording sheet S has come out of the nip position, this rear edge portion operates so as to be dropped from the nip portion to the platen 34. Consequently, the distance between the recording sheet and the recording head 7 fluctuates largely, and there is a case where an adverse influence is exercised on the recording quality. Therefore, in order to perform the high quality image recording, it is better that the distance between the pressure contact point of the pinch roller 37 to the conveying roller 36 and the platen 34 is small. In the case of recording a recording sheet of low rigidity such as plain paper or the like which is used for the general document printing, since a tear-resistance of the recording sheet is small, the action of the recording sheet can be stabilized by strongly pressing the recording sheet S onto the platen 34. However, according to such a method, since the recording sheet has been strongly pressed, a rebound similar to that in the case of the recording sheet of the high rigidity (FIG. 6) occurs as illustrated in FIG. 9. Therefore, in the case of the recording sheet of the low rigidity, it is necessary to descend the platen 34 or ascend the recording head 7 lest the recording sheet S enters a state illustrated by the symbol A and collides with the recording head until the rear edge of the recording sheet comes out of the nip portion between the recording head 7 and the platen 34.

Depending on the type of recording sheet S, there is also such a tendency that the recording sheet is curled toward the platen 34 side after it was recorded. In such a case, it is necessary to take a countermeasure so that the recording sheet does not enter the groove portion formed on the upper surface of the platen 34. For this purpose, it is necessary to control the recording sheet S in such a direction as to be floating in such a manner that the pressing force directing toward the platen 34 does not strongly act on the upper surface of the groove portion of the platen 34. In the case of the two-sided recording, when recording onto the second surface, there is a case where recording image quality of the second surface is largely influenced depending on the state of the recording sheet S changed by the recording of the first surface. In such a case, there is also an influence caused due to conveying conditions for recording onto the second surface.

As a method of coping with such problems, there is considered a method whereby after the image was recorded onto the first surface, the recording onto the second surface is reserved and enters a standby mode until the recording sheet is dried. There is also considered a method whereby the recording sheet S gets into a habit of the curl by holding the recording sheet in the standby mode on the bent conveying path, the curling tendency of the recording sheet S is oriented, or the like. According to such methods, however, a recording speed in the two-sided recording is remarkably reduced. There is also a case where the rigidity, curling situation (direction, amount), or the like of the recording sheet S changes largely also due to an environment such as atmospheric temperature, humidity, or the like around the recording apparatus, whereby a defective conveyance such as occurrence of a sheet passage jam, rubbing with the recording head 7, or the like may occur. Under such a situation, the distance between the recording sheet S and the recording head 7 does not become stable, causing a deterioration in recording quality.

Figure 10:
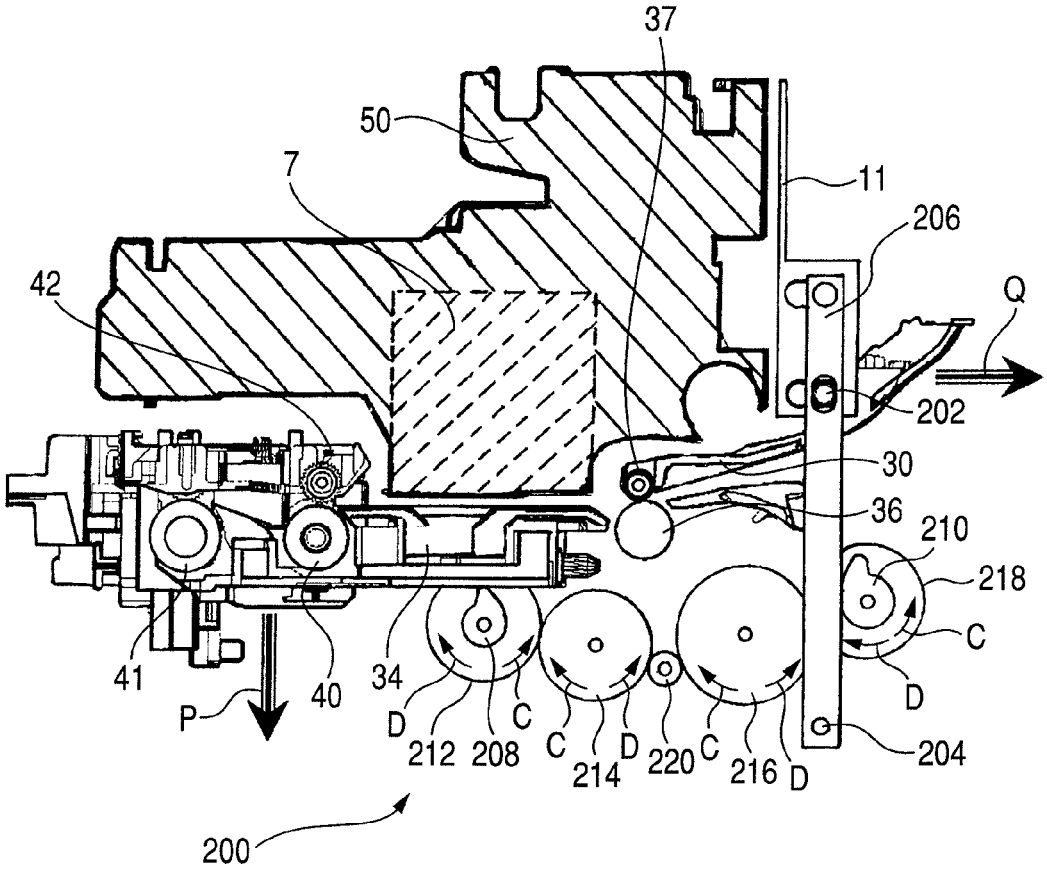
FIG. 10 is a vertical sectional view illustrating a state where the pressing force of the recording sheet onto the platen is small in a moving mechanism of the pinch roller and the platen of the recording apparatus according to the embodiment of the invention.
Figure 11:
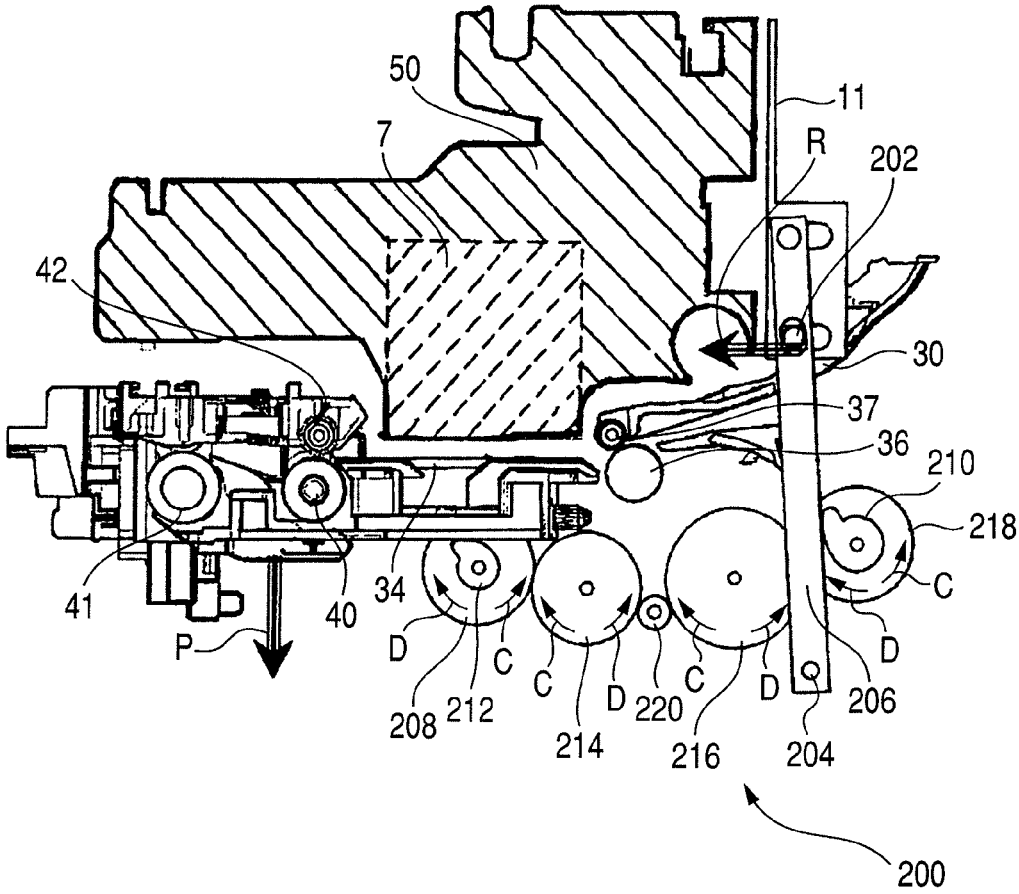
FIG. 11 is a partial diagram illustrating a state of a curl of the recording sheet at the pressure contact position of the pinch roller in the case where a curve degree and a curving direction of a pressing conveying path of the recording sheet onto the platen are different in the moving mechanism of the pinch roller and the platen in FIG. 10.

FIGS. 10 and 11 are vertical sectional views illustrating a moving mechanism 200 of the pinch roller and the platen of the recording apparatus according to the embodiment of the invention. FIG. 10 illustrates the case where the pressing force of the recording sheet onto the platen is relatively small. FIG. 11 illustrates the case where the pressing force of the recording sheet onto the platen is relatively large. Subsequently, the moving mechanism 200 of the pinch roller and the platen of the recording apparatus according to the embodiment of the invention will be described with reference to FIGS. 10 and 11.

In FIGS. 10 and 11, the pinch roller 37 is rotatably and axially supported to a front edge portion of the pinch roller holder 30. The pinch roller holder 30 is supported so that it can pivot around a movable fulcrum 202 as a center. A lever member 206, which is provided for the chassis 11 and can pivot around a fixed fulcrum 204 as a center, is axially supported. Each of a plurality of pinch rollers 37 is in pressure contact with the conveying roller 36 by an urging force of the pinch roller spring 31. The fulcrum 202 of the pinch roller holder 30 is fitted into a hole of the lever member 206. The pinch roller holder 30 is urged in the direction shown by an arrow Q by a holder spring (not shown). Therefore, the pinch roller holder 30 is held at a predetermined position by the lever member 206 against the holder spring (not shown). That is, when the lever member 206 rotates around the fixed fulcrum 204 as a center, the pinch roller holder 30 can be moved through the fulcrum 202. Thus, the pressure contact position of the pinch roller 37 to the conveying roller 36 can be moved.

The platen 34 is urged in the direction shown by an arrow P by a separating spring (not shown). The platen 34 is supported at a predetermined height position by a cam portion 208 against the separating spring. The lever member 206 is supported at a predetermined rotating position (pivoting position) by a cam portion 210 against an urging force of the holder spring. Therefore, the pinch roller holder 30 and the platen 34 are coupled by a gear train including gears 212, 214, 220, 216, and 218 and the cam portions 208 and 210. In the example illustrated in the diagrams, the cam portion 208, which contacts with the platen 34, rotates integratedly with the gear 212 and the cam portion 210, which contacts with the lever member 206, rotates integratedly with the gear 218.

Therefore, when the gear 220 is rotated by a motor, each gear rotates in the direction shown by an arrow C. Thus, the pinch roller holder 30 and the platen 34 are moved in an interlocking relational manner through the cam portions 208 and 210 and are shifted from the state of FIG. 10 to the state of FIG. 11. That is, as illustrated in FIG. 11, the platen 34 is descended by the spring urging force in the direction of the arrow P, and the pinch roller holder 30 is moved in the direction shown by an arrow R against the spring urging force by the counterclockwise (shown in the diagram) pivoting of the lever member 206. When the gears 212, 214, 220, 216, and 218 are rotated in the direction of an arrow D by the driving of the motor, the platen 34 and the pinch roller holder 30 are returned to the state of FIG. 10. That is, the platen 34 is elevated by the cam portion 208 against the spring urging force in the direction of the arrow P and is returned to the state of FIG. 10. Since the cam portion 210 retreats, the pinch roller holder 30 is moved to the right illustrated in the diagram by the clockwise pivoting of the lever member 206 due to the urging force of the holder spring and is returned to the state of FIG. 10.

When the pinch roller holder 30 is moved to the left illustrated in the diagram and reaches a position in FIG. 11, the pinch roller 37 is also similarly moved to the left, as illustrated in the diagram. At this time, since the pinch roller 37 has been urged to the conveying roller 36 by the pinch roller spring 31, the pinch roller 37 is moved in a state where it is in pressure contact with the conveying roller 36. Thus, the pressure contact position of the pinch roller 37 to the conveying roller 36 is moved to the left, as illustrated in the diagram. By the movement of the pinch roller 37, a common tangent of the conveying roller and the pinch roller changes so that an angle to the conveying surface of the platen 34 increases. Therefore, the progressing direction of the recording sheet S, which is sandwiched and conveyed by the conveying roller and the pinch roller, also changes in the same direction as that of the common tangent, and the recording sheet is strongly pressed by the platen 34.

Since the pressure contact position of the pinch roller 37 is moved almost horizontally in the upper portion of the conveying roller 36 as mentioned above, when the platen 34 descends to the position in FIG. 11, a distance in the vertical direction between the pressure contact position of the pinch roller 37 and the platen 34 increases. Therefore, a distance until the recording sheet S, which is conveyed to the platen 34 by the conveying roller 36, reaches the platen 34 can be increased. Consequently, an angle between the conveying direction and the conveying surface of the platen 34 at the time when the recording sheet S contacts with the platen 34 can be further increased. A point where the recording sheet S rebounds by the repulsion of the platen 34 can be deviated to the conveyance downstream side. By those actions, even if the recording sheet S rebounds, it can be conveyed without coming into contact with the recording head 7.

In the state of FIG. 10, the pressure contact position of the pinch roller 37 to the conveying roller 36 is also moved to the right, as illustrated in the diagram, and the angle between the common tangent at the pressure contact point and the platen 34 decreases. Therefore, the recording sheet S, which is conveyed by the conveying roller 36, contacts with the platen 34 at an angle near the parallel. Thus, the pressing force of the recording sheet S to the platen 34 decreases and a frictional load by the platen 34 also decreases. When the platen 34 is moved to the ascending position in FIG. 10, the pressure contact position of the pinch roller 37 is moved almost horizontally in the upper portion of the conveying roller 36, as mentioned above, so that the distance in the vertical direction between the pressure contact position of the pinch roller 37 and the platen 34 decreases. Therefore, even if the rear edge of the recording sheet S, which came out of the pressure contact point of the pinch roller 37, has been dropped onto the platen 34, the distance in the vertical direction to the recording head 7 hardly changes. Thus, the quality deterioration of the recorded image that is caused by a fluctuation in distance between the recording head 7 and the recording sheet S can be prevented.

The moving mechanism 200 of the pinch roller and the platen described above in FIGS. 10 and 11 can also be embodied in various forms other than the form illustrated in the diagrams. That is, although the platen 34 and the pinch roller 37 have been coupled by the cam and gear in the example illustrated in the diagrams, a construction in which the platen and the pinch roller are respectively driven by different driving sources can be also used. The spring urging in the position control of the platen 34 and the pinch roller 37 is not indispensable either, but a construction in which the motions of the platen and the pinch roller are controlled by the driving from the driving sources may be used.

Subsequently, an example of the position control of the platen and the pinch roller in the recording apparatus to which the invention is applied will be described. When a recording command is issued by the operation of the operator or from a control apparatus such as a personal computer, the control is made by the following procedure. That is, one of information of the type of recording sheet S and information of the rigidity of the recording sheet S which was detected by a sensor or the like (not shown) is preliminarily stored. When the recording command is issued, a parameter about an optimum offset amount of the pinch roller 37 stored in one of the recording apparatus and the control apparatus is selected. A parameter about the optimum pressure contact position of the pinch roller 37 to the conveying roller 36 and a parameter about the distance between the pressure contact position and the platen 34 are also selected. A command is issued to the driving source based on the selected parameters. The moving mechanism in FIGS. 10 and 11 is used, and the positions of the platen 34 and the pinch roller 37 are changed by the driving source through the gear train.

Figure 12:
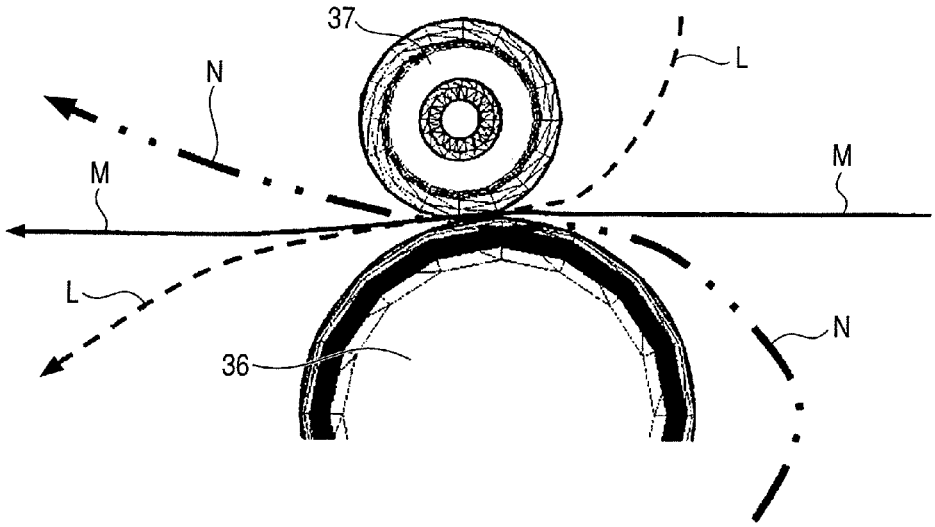
FIG. 12 is a partial diagram illustrating a state of a curl of the recording sheet at the pressure contact position of the pinch roller in the case where a bending amount and a bending direction of the conveying path are different.

FIG. 12 is a partial diagram illustrating a state of a curl of the recording sheet at the pressure contact position of the pinch roller 37 in the case where a bending amount and a bending direction of the conveying path are different. When the recording sheet which is fed by the feeding roller is conveyed with a strong bending property for the recording head 7, there is such a tendency that even after the sheet came out of the conveying roller 36, the sheet which is conveyed on the platen 34 is bent in any direction due to the repulsion by the bending. In FIG. 12, L denotes a bending state of the recording sheet which is fed from the rear upper portion of the apparatus main body. As illustrated by L, after the recording sheet was conveyed with a strong bending force to the recording head 7 from an upward position, if the sheet is conveyed in the horizontal direction in the image forming unit, there is such a tendency that the recording sheet which has passed through the image forming unit moves downward. That is, in the case of the recording sheet shown by L, there is such a tendency that after the sheet came out of the conveying roller 36, the sheet is bent and conveyed to the platen 34 side due to the repulsion of the bending. Therefore, the offset amount of the pinch roller 37 should be set to be smaller than that in the horizontal conveyance of M like a horizontal feed, thereby softening the collision with the platen 34. At the same time, in order to prevent the deterioration in image quality caused by the drop of the rear edge of the recording sheet, the distance between the pressure contact position of the pinch roller 37 and the platen 34 should be reduced.

In FIG. 12, N denotes a bending state of the recording sheet which is fed from the lower portion of the apparatus main body in the cassette feeding, the two-sided recording, or the like. As illustrated by N, after the recording sheet was conveyed from the lower portion with a strong bending force to the recording head 7 from a downward position, if the sheet is conveyed in the horizontal direction in the image forming unit, there is such a tendency that the recording sheet which has passed through the image forming unit moves upward. That is, in the case of the recording sheet shown by N, there is such a tendency that after the sheet came out of the conveying roller 36, the sheet is bent and conveyed to the recording head 7 side due to the repulsion of the bending. Therefore, the offset amount of the pinch roller 37 should be set to be larger than that in the horizontal conveyance like M and to increase the distance between the pressure contact point of the pinch roller 37 and the platen 34. Owing to such a construction, the rebound caused when the recording sheet collides with the platen 34 at a large angle can be prevented.

Subsequently, the position control of the pinch roller 37 and the platen 34 in the case of using the U-turn conveying unit 8 in the recording apparatus according to the embodiment will be described. First, the selection of the parameters at the time of recording onto the second surface is performed based on an amount of curl, a direction of the curl, a change in rigidity of the paper, or the like, which is presumed by an amount of deposited matter such as ink or the like recorded on the first surface. Second, the selection of the parameters is performed based on the amount of curl, the direction of the curl, and the like, which are presumed by distribution of a depositing area of the ink of the recording sheet whose first surface has been recorded. Third, the selection of the parameters is performed based on the changes in amount of curl and direction of the curl and the like, which are presumed by the type of ink recorded on the first surface, for example, a difference between pigment ink and dye ink or the like. Fourth, the selection of the parameters is performed based on the changes in amount of curl and direction of the curl and the like, which are presumed by an elapsed time from a point of time when the recording has been performed on the first surface. In this manner, the parameters of the optimum movement amounts or positions of the pinch roller 37 and the platen 34 are selected from the parameters which have previously been stored. A command is issued to the driving source based on the selected parameters. Thus, the moving mechanism in FIG. 10 is driven and the positions of the pinch roller and the platen are changed.

Conditions of the recording sheet depending on the amount of recorded ink are also influenced by a combination of the recording sheet type and the ink type. That is, although the degree and direction of the curl, which is liable to occur in the recording sheet after the recording, depend on the conditions, there is such a tendency that the curl amount increases in association with an increase in total amount of deposited ink. With respect to plain paper which does not use any special chemicals, there is such a tendency that the rigidity of the sheet just after the recording decreases in association with an increase in ink amount. In the case where, for example, the image has concentratedly been recorded to one of the rear edge portion and the front edge portion of the first surface, a curl is liable to occur on the back side of the recorded portion upon recording onto the second surface irrespective of the total amount of ink on the first surface. The direction and amount of the curl of the recording sheet also change depending on the combination of the type of ink which is used for recording and the recording sheet type, or the like.

Figures 13A, 13B, 13C:
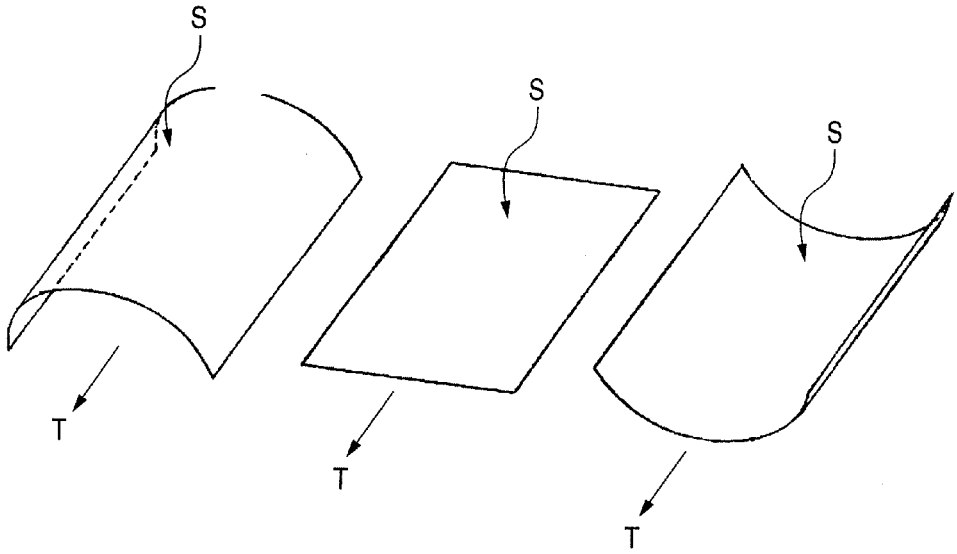
Figure 14:
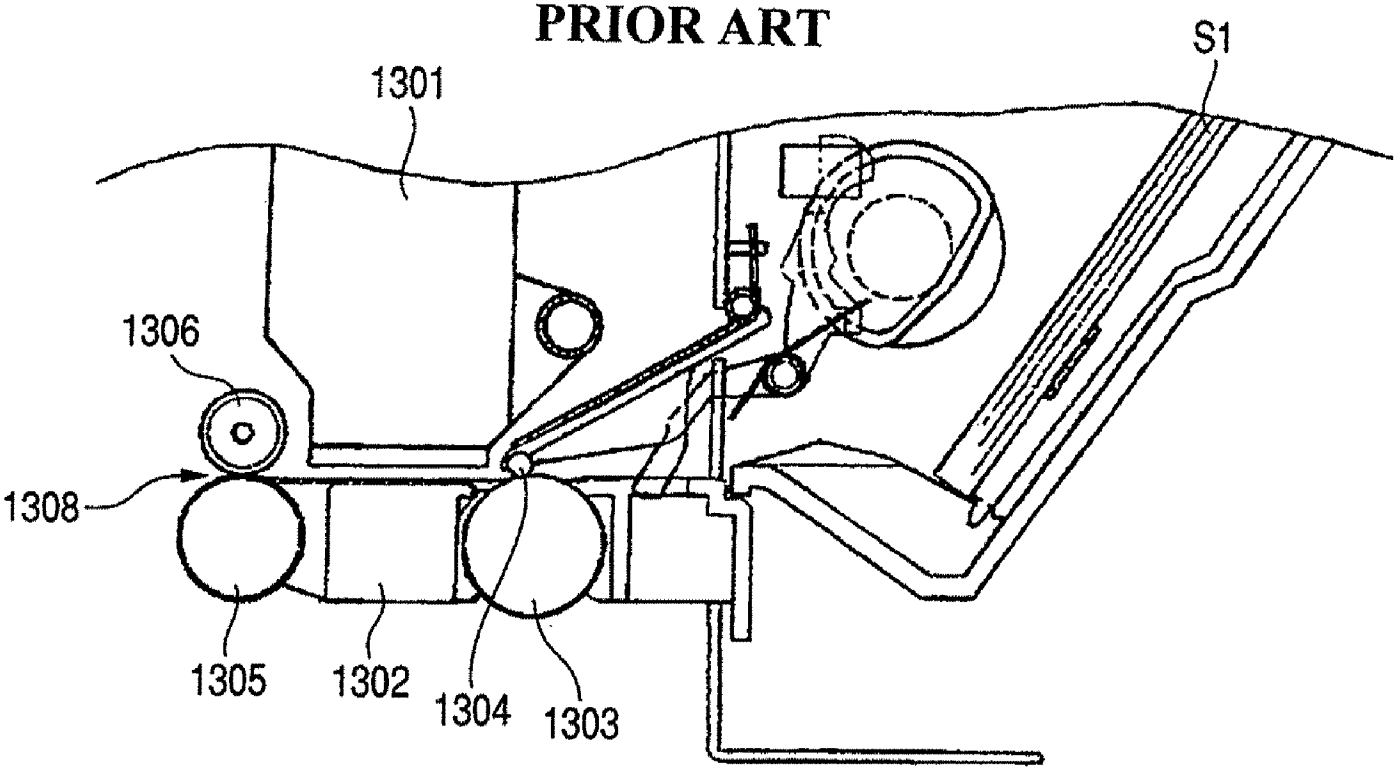
FIG. 14 PRIOR ART
FIG. 14 is a partial vertical sectional view illustrating a construction of an image forming unit of a recording apparatus in the related art.

Further, there is also a case where the curl amount or the curl direction of the recording sheet changes depending on the elapsed time after the recording onto the first surface. FIGS. 13A to 13C are schematic diagrams illustrating a state of the curl of the recording sheet S which is obtained after the recording. An arrow T in FIGS. 13A to 13C indicates a conveying direction. FIG. 13A illustrates the curl in such a direction that the recording surface is concave. FIG. 13B illustrates the state without any curl. FIG. 13C illustrates the curl in such a direction that the recording surface obtained after the recording is convex. In FIGS. 13A to 13C, for example, in the case where the recording sheet S is general plain paper, as the time elapses just after the recording, the recording sheet is gradually curled in such a direction that the recording surface becomes concave as illustrated in FIG. 13C. Such a tendency becomes remarkable as the amount of ink used for the recording is larger. In consideration of such recording conditions (ink amount and the like) of the first surface, the optimum parameter values regarding the pressing force of the recording sheet to the platen 34 and the distance between the pressure contact point of the pinch roller to the conveying roller 36 and the platen 34 are stored.

In another example of the position control of the platen 34 and the pinch roller 37, parameters of the optimum values regarding the movement amount of the pinch roller 37 and the movement amount of the platen 34 are selected based on environment information such as atmospheric temperature, humidity, and the like of the recording apparatus. As environment information in this case, there are environment information which has been preset, environment information which has been set by being presumed from a date, or environment information which has been detected by a sensor or the like (not shown). In the position control of the moving mechanism 200 in FIG. 10, when there is a recording command by an operation of the user or from the control apparatus such as a personal computer or the like connected to the recording apparatus, the adapted parameters are selected and the command is issued to the driving source of the moving mechanism mentioned above. Based on this command, the positions of the pinch roller 37 and the platen 34 are changed by the driving source through the moving mechanism in FIG. 10.

For example, among the recording sheets for the high quality recording, there is a sheet having such a tendency that it is curled as illustrated in FIG. 13A or 13C under an environment of a low temperature and a low humidity such as an environment of the atmospheric temperature of 5° C. and the humidity of 10%, or the like. In the case of such a recording sheet, since the moisture contained in the sheet itself also decreases, the rigidity of the recording sheet increases. Also in the case of the plain paper of the low rigidity, the rigidity changes depending on the amount of moisture contained in the recording sheet itself. Therefore, the parameters have been set and stored in consideration of the change in property of the recording sheet that is caused by the conditions of the environment as mentioned above. That is, the parameters about the optimum values of the pressing amount of the recording sheet to the platen 34 and the distance in the vertical direction between the pressure contact point of the pinch roller 37 to the conveying roller 36 and the platen 34 have been set and stored.

In another example of the position control of the platen 34 and the pinch roller 37, the movement amount is controlled based on the recording sheet type, a type of sheet stacking unit, a recording environment where the recording apparatus has been provided, a recording situation of the first surface in the two-sided recording, or the like. In the present example, the control of the movement amount is made based on a combination of a plurality of factors among the factors which exert an influence on the action of the recording sheet in the conveying path. Also in this example, parameters of an optimum offset amount of the pinch roller 37 and the height difference between the pressure contact position of the pinch roller 37 to the conveying roller 36 and the platen 34 have previously been stored in one of the recording apparatus and the control apparatus. Among those factors, the factor which exerts a largest influence on the action of the recording sheet is selected. The parameter having the optimum value is selected for such a factor. Or, a weight is set according to an influence degree of each factor, the conditions of the recording sheet are decided in consideration of the weights, and the parameter is selected for such conditions. Further, an average value of the parameters that are optimum to each factor may be obtained and used as a parameter for the position control according to circumstances.

The moving mechanism 200 in FIG. 10 is controlled based on the parameter obtained as mentioned above. That is, also in this example, when there is the recording command by the operation of the user or from the control apparatus such as a personal computer or the like connected to the recording apparatus, the command is issued to the driving source of the moving mechanism in FIG. 10 based on this parameter. The positions of the pinch roller 37 and the platen 34 are changed from the driving source through the moving mechanism 200, based on this command. However, the selecting method of the parameter for each factor described in the embodiment has been mentioned as an example. The invention is not limited to such method but the control may be properly made in consideration of a plurality of factors.

According to the embodiment as described above, even in the case of recording by using the various recording sheets and various recording conditions, the optimum conveying state can be realized in the image forming unit and the high quality recording image can be obtained. As various recording sheets and various recording conditions, for example, there is a case where the parameters have the different optimum values with respect to the pressure contact position of the pinch roller 37 to the conveying roller 36 and the distance between the pressure contact position and the platen 34. The standby operation for stabilizing the action of the recording sheet which is being conveyed can be eliminated. The standby time can be reduced. A throughput of the whole recording operation can be improved. Further, the above effects can be accomplished by the simple construction without causing an enlargement of the recording apparatus.

The invention can be applied irrespective of the recording head type and the number of recording heads. The invention can be similarly applied to any of a construction of a cartridge type in which the recording head and the ink tank are integrated, a construction in which the recording head and the ink tank are separated, and the like irrespective of the construction of the recording head and the ink tank. In the above embodiments, the recording apparatus of the serial type using the recording head mounted in the carriage has been mentioned as an example. The invention can be also similarly applied to a recording apparatus of the line type in which the recording is executed only by the sub-scan by using a recording head having a length corresponding to a width of recording sheet.

According to the embodiments of the invention, it is possible to provide the recording apparatus in which the pressure contact position of the pinch roller to the conveying roller and the distance between the pressure contact position of the pinch roller and the platen can be properly set in correspondence to the different recording conditions, and the high quality recording can be performed even under the different recording conditions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-053752, filed Mar. 5, 2007, which is hereby incorporated by reference herein in its entirety.

What is claimed is:

1. A recording apparatus for recording onto a recording sheet by a recording head, comprising:

a platen configured to guide the recording sheet to a position facing the recording head;

a conveying roller configured to convey the recording sheet on an upstream side of the platen in a conveying direction of the recording sheet;

a pinch roller configured to contact with the conveying roller;

moving means for moving the platen to change a position of the platen; and a pinch roller holder rotatably holding the pinch roller, wherein the recording sheet conveyed by the conveying roller is nipped at a nip by the conveying roller and the pinch roller, and wherein the pinch roller and the conveying roller have a pressure contact position, the tangent thereof forming a non-zero angle with respect to the platen, and wherein the moving means is configured to move the pressure contact position of the pinch roller and the conveying roller such that the non-zero angle is increased or decreased.

2. An apparatus according to claim 1, wherein the moving means changes the positions of the pinch roller and the platen according to a type of the recording sheet being conveyed.

3. An apparatus according to claim 2, wherein when the recording sheet having a first rigidity is conveyed, the pinch roller is positioned at a first position, and when a recording sheet having a second rigidity higher than the first rigidity is conveyed, the pinch roller is moved to a second position so as to decrease an angle of a tangent at the pressure contact position to the platen.

4. An apparatus according to claim 3, wherein when the recording sheet having the first rigidity is conveyed, the platen roller is positioned at a third position, and when the recording sheet having the second rigidity higher than the first rigidity is conveyed, the platen is moved to a forth position, wherein the forth position is nearer to the nip as compared with the third position.

5. An apparatus according to claim 1, further comprising a plurality of feeding units configured to feed the recording sheet, wherein the positions of the pinch roller and the platen are changed by the feeding units.

6. An apparatus according to claim 5, wherein when the recording sheet is fed from the feeding unit and the fed recording sheet is conveyed while being bent to the platen side, the pinch roller is moved so as to decrease an angle of a tangent at the pressure contact position to the platen.

7. An apparatus according to claim 6, wherein the platen is moved in such a direction that the platen approaches the pressure contact position.

8. An apparatus according to claim 5, wherein when the recording sheet is fed from the feeding unit and the fed recording sheet is conveyed while being bent to the recording head side, the pinch roller is moved so as to increase an angle of a tangent at the pressure contact position to the platen.

9. An apparatus according to claim 8, wherein the platen is moved in such a direction that the platen is away from the pressure contact position.

10. An apparatus according to claim 1, further comprising a reversing path facilitating reversing the recording sheet in order to execute the recording to a second surface of the recording sheet whose first surface has been recorded by the recording head, wherein when the recording is executed to the second surface, the position of the pinch roller or the platen is changed from that upon executing the recording to the first surface.

* * * * *